US006664742B2

(12) United States Patent
Venkatraman et al.

(10) Patent No.: US 6,664,742 B2
(45) Date of Patent: Dec. 16, 2003

(54) FILAMENT CUT-BACK CIRCUIT

(75) Inventors: Ramakrishnan Venkatraman, Des Plaines, IL (US); Michael Y. Zhang, Buffalo Grove, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 15 days.

(21) Appl. No.: 10/043,530

(22) Filed: Jan. 11, 2002

(65) Prior Publication Data

US 2003/0132718 A1 Jul. 17, 2003

(51) Int. Cl.[7] ..... H01J 7/24

(52) U.S. Cl. ..... 315/116; 315/225; 315/244; 315/209 R; 315/224

(58) Field of Search ..... 315/115, 116, 315/106, 307, 224, 291, 225, 209 R, 244

(56) References Cited

U.S. PATENT DOCUMENTS 4,376,911 A * 3/1983 Kaneda ..... 315/244
5,057,750 A * 10/1991 Farrall et al. ..... 315/248
5,118,997 A * 6/1992 El-Hamamsy ..... 315/248
5,200,672 A 4/1993 Sheynberg et al.
5,541,482 A 7/1996 Siao
5,592,054 A * 1/1997 Nerone et al. ..... 315/209 R
5,789,866 A * 8/1998 Keith et al. ..... 315/105
5,923,126 A 7/1999 Yang et al.
6,054,815 A * 4/2000 Sugita et al. ..... 315/224

* cited by examiner

*Primary Examiner*—Don Wong
*Assistant Examiner*—Ephrem Alemu

(57) ABSTRACT

A filament cut-back circuit comprises an impedance circuit coupled in series between either an AC voltage source and a primary filament winding, or a secondary filament winding and a filament. In response to an alternating voltage from the AC voltage source when coupled in series thereto or an alternating voltage from the secondary filament winding when coupled in series thereto, the impedance circuit operates as a short circuit when the alternating voltage is at a preheat frequency and operates as an open circuit when the alternating voltage is at an operating frequency.

31 Claims, 4 Drawing Sheets

12

FILAMENT CUT-BACK CIRCUIT

BACKGROUND OF THE INVENTION

1. Field of the Invention

The present invention generally relates to an operation of a lamp. The present invention specifically relates to filament cutback.

2. Description of the Related Art

When lamps are operated by a programmed-start ballast, which by definition requires heating,of the lamp filaments before lamp ignition, the lamp life is increased. The heating of the lamp filaments typically cease upon lamp ignition in order to reduce losses during normal operation of the lamp. Also, it is important not to exceed the lead current limits given by the lamp manufacturer. Hence, a good filament cutback circuit is necessary for improved lamp performance and reduced power loss at normal operation.

One filament cutback circuit as known in the art employs a capacitor in series with a filament winding and a filament to achieve a first-order cut back. A second filament cutback circuit as known in the art employs a parallel coupling of a capacitor and an inductor coupled in series between the filament winding and the filament. This circuit operates as a low impedance circuit during a preheating of the lamp filaments, and as an open circuit (i.e., infinite impedance) during normal operation of the lamp. A third filament cutback circuit as known in the art employs a series coupling of a capacitor and an inductor coupled in series between the filament winding and the filament. This circuit operates as a short circuit (i.e., zero impedance) during a preheating of the lamp filaments, and as a high impedance circuit during normal operation of the lamp.

The present invention is an improvement over the aforementioned prior art filament cut-back circuits.

SUMMARY OF THE INVENTION

The present invention is a filament cut-back circuit. Various aspects of the present invention are novel, non-obvious, and provide various advantages. While the actual nature of the present invention covered herein can only be determined with reference to the claims appended hereto, certain features, which are characteristic of the embodiments disclosed herein, are described briefly as follows.

One form of the present inventions is a filament cut-back circuit comprising a filament winding and an impedance circuit in electrical communication with said filament winding. The impedance circuit operates as a short circuit in response to a reception of an alternating voltage at a preheat frequency. The impedance circuit operates as an open circuit in response to a reception of an alternating voltage at an operating frequency.

The foregoing form as well as other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

DETAILED DESCRIPTION OF THE PRESENTLY PREFERRED EMBODIMENTS

Figure 1:
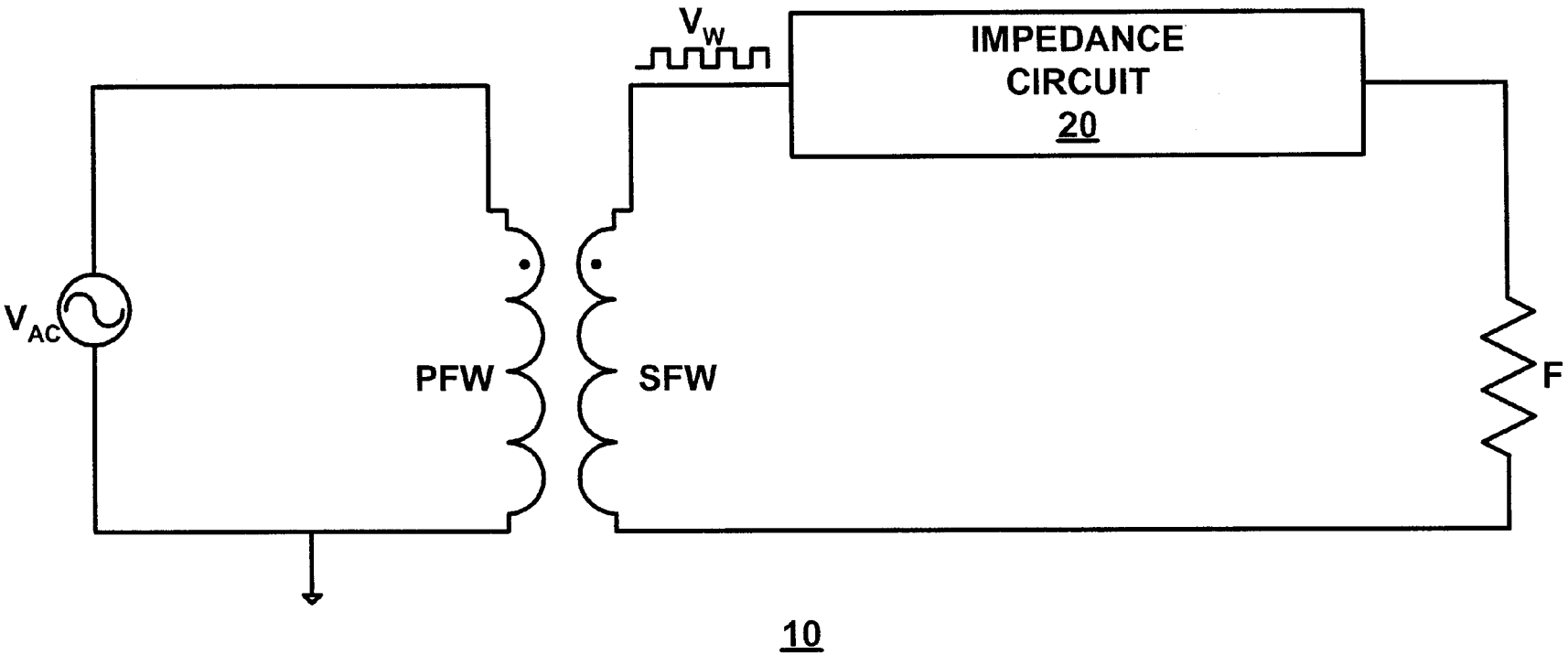
FIG. 1 illustrates a first embodiment of a filament cut-back circuit in accordance with the present invention.

FIG. 1 illustrates a filament cut-back circuit 10 of the present invention. Circuit 10 comprises an alternating current ("AC") voltage source $V_{AC}$ coupled to a primary filament winding PFW whereby a secondary filament winding SFW provides an alternating winding voltage $V_W$ in square wave form. Circuit 10 further comprises a new and unique impedance circuit 20 coupled in series between secondary filament winding SFW and a filament F. In response to alternating winding voltage $V_W$, impedance circuit 20 operates as a short circuit during a pre-heat frequency of winding voltage $V_W$ (typically 90 kHz), which is any time prior to an ignition of a lamp containing filament F. Subsequently, impedance circuit 20 operates as an open circuit during an operating frequency of winding voltage $V_W$ (typically, 45 kHz), which is after the ignition of the lamp. Impedance circuit 20 further serves to provide a high impedance at a third and higher harmonic frequency, which is important in view of a significant third and higher harmonic content of winding voltage $V_W$. With impedance circuit 20, winding current (not shown) associated with winding voltage $V_W$would be high during a pre-heat frequency of winding voltage $V_W$and low during an operating frequency of winding voltage $V_W$. This would give good preheat energy to filament F and reduce losses during normal operation of filament F.

Figure 2:
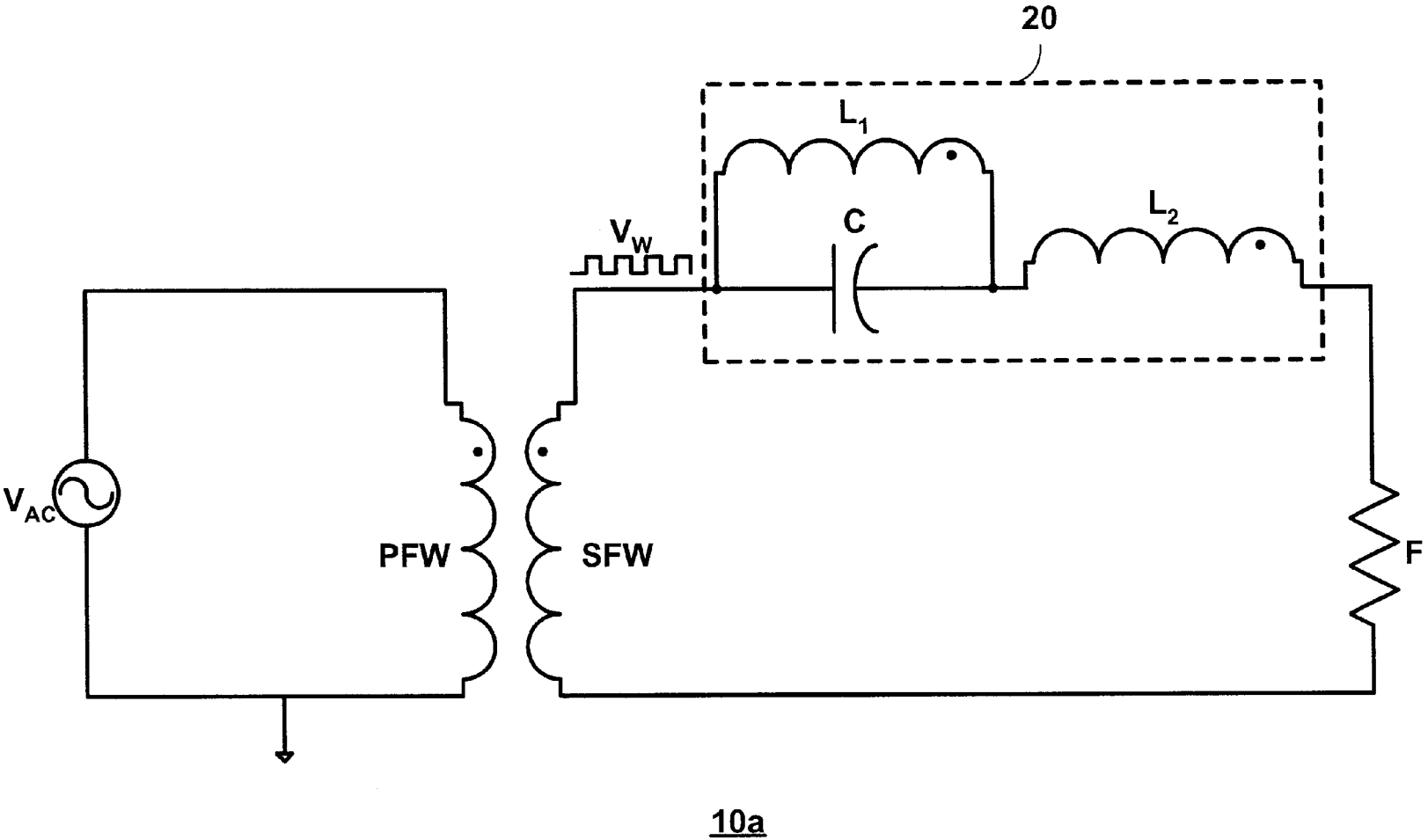
FIG. 2 illustrates a first embodiment of the FIG. 1 impedance circuit.

FIG. 2 illustrates a filament cut-back circuit 10*a* including one embodiment of impedance circuit 20. A capacitor C and an inductor $L_1$ are coupled in parallel. This parallel coupling of capacitor C and inductor $L_1$ is coupled in series between the filament winding FW and an inductor $L_2$. Inductor $L_2$ is further coupled in series to the filament F. The impedance established by capacitor C, inductor $L_1$, and inductor $L_2$ is in accordance with the following equation[1]:

$$Z(w) = \frac{jw[(L_1 + L_2) - w^2 \cdot L_1 \cdot L_2 \cdot C]}{1 - w^2 \cdot L_1 \cdot C} \quad [1]$$

where j is square-root of −1, and w is the frequency of winding voltage $V_W$ in radians/sec.

In order to operate as a short circuit during the pre-heat frequency of winding voltage $V_W$, the capacitance of capacitor C, the inductance of inductor $L_1$, and the inductance of inductor $L_2$ is in accordance with the following equation [2]:

$$[(L_1+L_2)-w^2 \cdot L_1 \cdot L_2 \cdot C]:=0 \quad [2]$$

In order to operate as an open circuit during the operating frequency of winding voltage $V_W$, the capacitance of capacitor C and the inductance of inductor $L_1$ is in accordance with the following equation [3]:

$$(1-w^2 \cdot L_1 \cdot C):=0 \quad [3]$$

Figure 3:
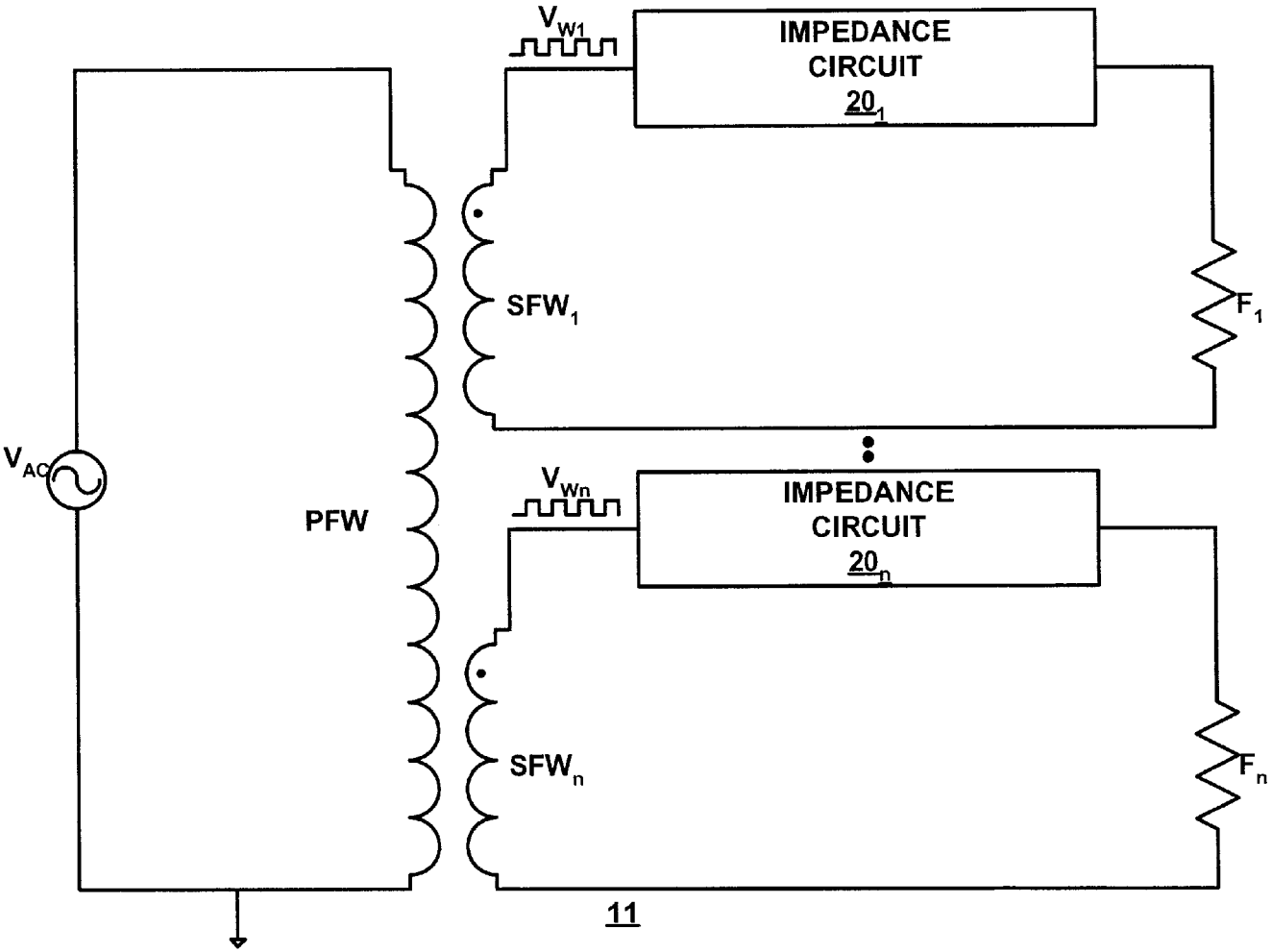
FIG. 3 illustrates a second embodiment of a filament cut-back circuit in accordance wit he present invention.

FIG. 3 illustrates a filament cut-back circuit 11 of the present invention. Circuit 11 comprises AC voltage source $V_{AC}$ coupled to primary filament winding PFW as previously described in connection with FIG. 1. Circuit 11 further comprises a first series coupling of a secondary filament winding $SFW_1$, an impedance circuit $\mathbf{20}_1$ and a filament $F_n$ to a nth series coupling of secondary filament winding $SFW_n$, an impedance circuit $\mathbf{20}_n$ and a filament $F_n$. Each impedance circuit $\mathbf{20}_1$–$\mathbf{20}_n$ operates in the same manner as an operation of impedance circuit 20 as described in connection with FIG. 1. Additionally, each impedance circuit $\mathbf{20}_1$–$\mathbf{20}_n$ can employ the embodiment of impedance circuit 20 as described in connection with FIG. 2.

Figure 4:
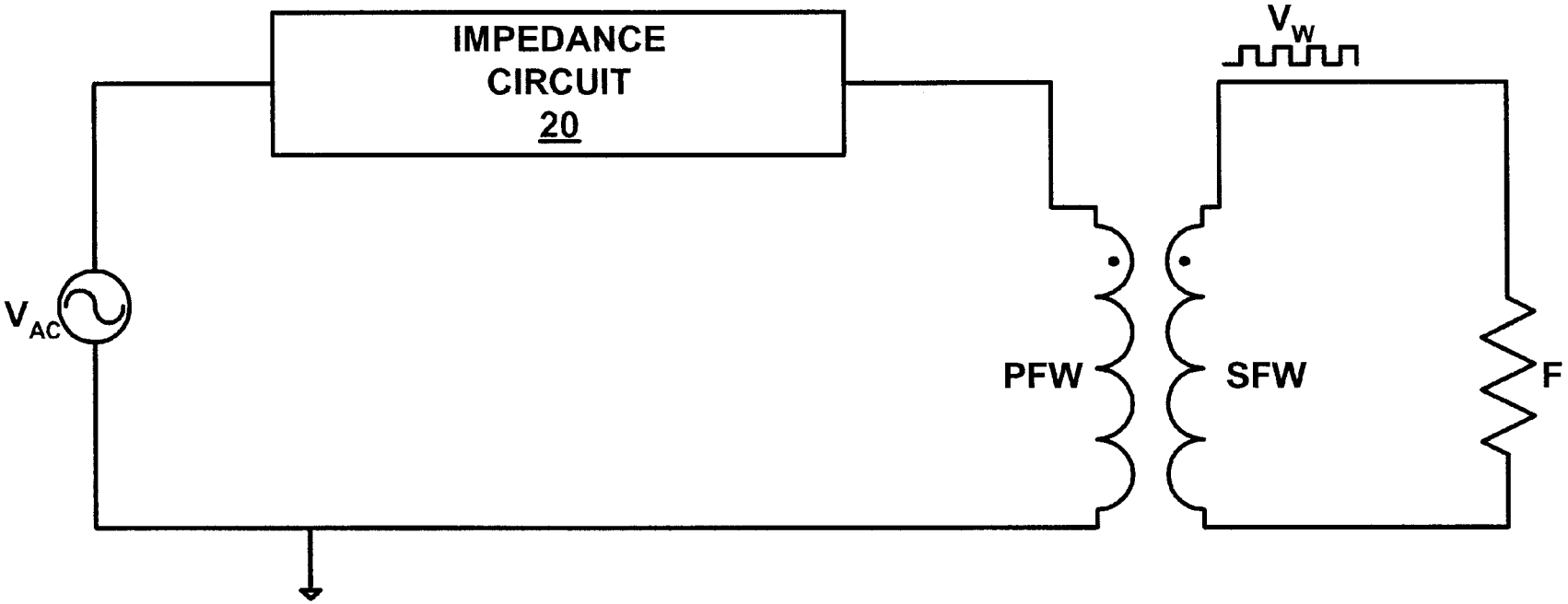
FIG. 4 illustrates a third embodiment of a filament cut-back circuit in accordance with the present invention.

FIG. 4 illustrates a filament cut-back circuit 12 of the present invention. Circuit 12 comprises impedance circuit 20 coupled in series between AC voltage source $V_{AC}$ and primary filament winding PFW. Impedance circuit 20 operates in response to a reception of an alternating source voltage (not shown) from AC voltage source $V_{AC}$ in an analogous manner to the operation of impedance circuit 20 in response to a reception of alternating winding voltage $V_W$ as described in connection with FIG. 1. Additionally, impedance circuit 20 can employ the embodiment of impedance circuit 20 as described in connection with FIG. 2 in an analogous manner to the employment of the embodiment of impedance circuit 20 in circuit 10*a*.

While the embodiments of the present invention disclosed herein are presently considered toe preferred, various changes and modifications cane made without departing from the spirit and scope of the present invention. The scope of the present invention is indicated in the appended claims, and all changes that come within the meaning and range of equivalents are intended to be embraced therein.

What is claimed is:

1. A filament cut-back circuit, comprising:

a filament winding;

an impedance circuit in electrical communication with said filament winding, wherein said impedance circuit operates as a short circuit in response to a reception of an alternating voltage at a preheat frequency, and wherein said impedance circuit operates as an open circuit when the alternating voltage is at an operating frequency.

2. The filament cut-back circuit of claim 1, wherein said impedance circuit operates to provide an impedance at a third harmonic frequency of the operating frequency of the alternating voltage.

3. The filament cut-back circuit of claim 1, wherein said filament winding is operable to provide a winding voltage as said alternating voltage.

4. The filament cut-back circuit of claim 1, wherein said impedance circuit is operable to receive the alternating voltage from an AC voltage source.

5. A filament cut-back circuit comprising:

a filament winding;

an impedance circuit in electrical communication with said filament winding, wherein said impedance circuit operates as a short circuit in response to a reception of an alternating voltage at a preheat frequency, and wherein said impedance circuit operates as an open circuit when the alternating voltage is at an operating frequency, wherein said impedance circuit includes:

a first inductor ($L_1$);

a capacitor (C) coupled in parallel to said first inductor ($L_1$); and a second inductor ($L_2$) coupled in series to the parallel coupling of said first inductor ($L_1$) and said capacitor (C).

6. The filament cut-back circuit of claim 5, wherein an impedance Z(w) of said impedance circuit is according to:

$$Z(w) = \frac{jw[(L_1 + L_2) - w^2 \cdot L_1 \cdot L_2 \cdot C]}{1 - w^2 \cdot L_1 \cdot C}.$$

7. The filament cut-back circuit of claim 5, wherein a first inductance of said first inductor ($L_1$), a capacitance of said capacitor (C), and a second inductance of said second inductor ($L_2$) is according to:

$$[(L_1+L_2)-w^2 \cdot L_1 \cdot L_2 \cdot C]:=0.$$

8. The filament cut-back circuit of claim 5, wherein an inductance of said first inductor ($L_1$) and a capacitance of said capacitor (C) is according to:

$$(1-w^2 \cdot L_1 \cdot C):=0.$$

9. A filament cut-back circuit, comprising a filament winding; and an impedance circuit in electrical communication with said filament winding, said impedance circuit including a first inductor ($L_1$), a capacitor (C) coupled in parallel to said first inductor ($L_1$) to constitute a parallel coupling of said first inductor ($L_1$) and said capacitor (C), and a second inductor ($L_2$) coupled in series to the parallel coupling of said first inductor ($L_1$) and said capacitor (C).

10. The filament cut-back circuit of claim 9, wherein said filament winding is coupled in series to said parallel coupling of said first inductor ($L_1$) and said capacitor (C).

11. The filament cut-back circuit of claim 9, wherein said filament winding is coupled in series to said second inductor ($L_2$).

12. The filament cut-back circuit of claim 9, wherein an impedance Z(w) of said impedance circuit is according to:

$$Z(w) = \frac{jw[(L_1 + L_2) - w^2 \cdot L_1 \cdot L_2 \cdot C]}{1 - w^2 \cdot L_1 \cdot C}.$$

13. The filament cut-back circuit of claim 9, wherein:

said impedance circuit is operable to receive an alternating voltage; and said capacitor (C), said first inductor ($L_1$) and said second inductor ($L_2$) operate as a short circuit when the alternating voltage is at a preheat frequency.

14. The filament cut-back circuit of claim 13, wherein a first inductance of said first inductor ($L_1$), a capacitance of said capacitor (C), and a second inductance of said second inductor ($L_2$) is according to:

$$[(L_1+L_2)-w^2 \cdot L_1 \cdot L_2 \cdot C]:=0.$$

15. The filament cut-back circuit of claim 9, wherein:

said impedance circuit is operable to receive an alternating voltage; and said capacitor (C), said first inductor ($L_1$) and said second inductor ($L_2$) operate as an open circuit when the alternating voltage is at an operating frequency.

16. The filament cut-back circuit of claim 15, wherein an inductance of said first inductor ($L_1$) and a capacitance of said capacitor (C) is according to:

$$(1-w^2 \cdot L_1 \cdot C):=0.$$

17. A method of operating a filament cut-back circuit including an impedance circuit, said method comprising:

operating the filament cut-back circuit to provide an alternating voltage at a preheat frequency;

operating the impedance circuit as a short circuit in response to the alternating voltage being at the preheat frequency;

operating the filament cut-back circuit to provide the alternating voltage at an operating frequency subsequent to the alternating voltage being at the preheat frequency; and operating the impedance circuit as an open circuit in response to the alternating voltage being at the operating frequency.

18. The method of claim 17, wherein the impedance circuit includes a capacitor (C), a first inductor ($L_1$) and a second inductor ($L_2$), said method further comprising:

establishing an impedance Z(w) of the impedance circuit according to:

$$Z(w) = \frac{jw[(L_1 + L_2) - w^2 \cdot L_1 \cdot L_2 \cdot C]}{1 - w^2 \cdot L_1 \cdot C}.$$

19. A method of operating an impedance circuit employed within a filament cut-back circuit, the impedance circuit including a capacitor (C), a first inductor ($L_1$) and a second inductor ($L_2$), said method comprising:

operating the impedance circuit as a short circuit in response to reception of an alternating voltage being at a preheat frequency; and subsequently operating the impedance circuit as an open circuit in response to the alternating voltage being at an operating frequency.

20. The method of claim 19, further comprising:

establishing an impedance Z(w) of the impedance circuit in according to:

$$Z(w) = \frac{jw[(L_1 + L_2) - w^2 \cdot L_1 \cdot L_2 \cdot C]}{1 - w^2 \cdot L_1 \cdot C}.$$

21. The method of claim 19, further comprising:

establishing a first inductance of said first inductor ($L_1$), a capacitance of said capacitor (C), and a second inductance of said second inductor ($L_2$) according to:

$$[(L_1+L_2)-w^2 \cdot L_1 \cdot L_2 \cdot C]:=0.$$

22. The method of claim 19, further comprising:

establishing an inductance of said first inductor ($L_1$) and a capacitance of said capacitor (C) according to:

$$(1-w^2 \cdot L_1 \cdot C):=0.$$

23. The filament cut-back circuit as claimed in claim 1 for operation with a discharge lamp having a filament, and further comprising:

means for applying said alternating voltage to the impedance circuit with said preheat frequency prior to lamp ignition and with said operating frequency after ignition of the discharge lamp.

24. The filament cut-back circuit as claimed in claim 23 wherein the filament winding comprises a transformer having a primary winding coupled to the alternating voltage applying means and a secondary winding coupled to the filament of the discharge lamp via the impedance circuit.

25. A filament cut-back circuit for operation with a discharge lamp having a filament, the filament cut-back circuit comprising:

filament winding means, an impedance circuit electrically coupled to the filament winding means, and means for applying an alternating voltage to the impedance circuit at a preheat frequency prior to lamp ignition and at an operating frequency after ignition of the discharge lamp, wherein said impedance circuit operates as a short circuit in response to the alternating voltage at the preheat frequency, and wherein said impedance circuit operates as an open circuit when the alternating voltage is at the operating frequency.

26. The filament cut-back circuit as claimed in claim 25 wherein the impedance circuit comprises first and second inductors and a capacitor coupled together so as to provide said short circuit at the preheat frequency and to provide said open circuit at the operating frequency of the discharge lamp.

27. The filament cut-back circuit as claimed in claim 26 wherein said capacitor and the second inductor of the impedance circuit provide the short circuit when the alternative voltage is at the preheat frequency and at least the capacitor and the first inductor of the impedance circuit provide the open circuit when the alternating voltage is at the operating frequency.

28. The filament cut-back circuit as claimed in claim 25 wherein the preheat frequency is significantly higher than the operating frequency of the discharge lamp.

29. The filament cut-back circuit as claimed in claim 25 wherein:

the filament winding means comprises a transformer having a primary winding coupled to the alternating voltage applying means and a secondary winding, and means for coupling the impedance circuit and discharge lamp filament in series circuit to the transformer secondary winding.

30. The filament cut-back circuit as claimed in claim 25 wherein the impedance circuit comprises inductor means and capacitor means coupled together to form first and second resonant circuits at the preheat frequency and the operating frequency, respectively.

31. The filament cut-back circuit as claimed in claim 25 wherein the impedance circuit comprises inductor means and capacitor means coupled together, and the inductor means and the capacitor means have fixed values of inductance and capacitance, respectively.

* * * * *